US009221654B2

(12) United States Patent
van der Schans et al.

(10) Patent No.: US 9,221,654 B2
(45) Date of Patent: Dec. 29, 2015

(54) METHOD AND SYSTEM FOR COUPLING AN OFFSHORE STRUCTURE TO A HOISTING BLOCK OF A HOISTING INSTALLATION

(75) Inventors: Mathijs Joannes van der Schans, Hardinxveld-Giessendam (NL); Arle Martinus Schenkel, Maasland (NL)

(73) Assignee: Societe d'Exploitation du Pieter Schelte N.V., Essen (BE)

( * ) Notice: Subject to any disclaimer, the term of this patent is extended or adjusted under 35 U.S.C. 154(b) by 25 days.

(21) Appl. No.: 14/007,224

(22) PCT Filed: Mar. 26, 2012

(86) PCT No.: PCT/EP2012/055341
§ 371 (c)(1),
(2), (4) Date: Jan. 8, 2014

(87) PCT Pub. No.: WO2012/130807
PCT Pub. Date: Oct. 4, 2012

(65) Prior Publication Data

US 2014/0112737 A1 Apr. 24, 2014

(30) Foreign Application Priority Data

Mar. 25, 2011 (NL) ..... 2006474

(51) Int. Cl.
*B66C 1/34* (2006.01)
*B66C 13/02* (2006.01)
(Continued)

(52) U.S. Cl.
CPC ... *B66C 1/34* (2013.01); *B66C 1/36* (2013.01); *B66C 13/02* (2013.01); *B66C 23/52* (2013.01); *E02B 2017/0052* (2013.01)

(58) Field of Classification Search
CPC ..... B63C 7/20; B63C 11/50; B66C 1/34; B66C 13/02; B66C 23/52; B66C 23/53; E02B 2017/0052
USPC ..... 294/66.1, 66.2, 82.24, 82.31
See application file for complete search history.

(56) References Cited

U.S. PATENT DOCUMENTS 2,986,421 A * 5/1961 Grove ..... 294/82.3
3,661,416 A * 5/1972 Bukarkin et al. ..... 294/82.32
(Continued)

FOREIGN PATENT DOCUMENTS

GB 2403706 1/2005
WO 2008068482 6/2008

OTHER PUBLICATIONS

International Search Report for PCT patent application No. PCT/EP2012/055341 issued Jun. 5, 2012.
(Continued)

*Primary Examiner* — Dean Kramer
(74) *Attorney, Agent, or Firm* — Meyertons, Hood, Kivlin, Kowert & Goetzel, P.C.; Eric B. Meyertons

(57) ABSTRACT

The present invention is related to a method for coupling an offshore structure (1), such as a jacket leg of an offshore platform, to a hoisting block (19) of a hoisting installation (13), preferably a floating hoisting installation. The present invention is also related to a hoisting block provided with a first coupling part of a system according to the invention and to an offshore structure provided with a second coupling part of a system according to the invention. The present invention is further related to a method for coupling a jacket of an offshore platform comprising a number of jacket legs to hoisting blocks suspended from hoisting cables (17) of a hoisting installation, wherein each jacket leg is coupled to a hoisting block according to the method for coupling a jacket leg of an offshore platform to a hoisting block suspended from hoisting cables of a hoisting installation according to the invention.

18 Claims, 8 Drawing Sheets

(51) Int. Cl.

| | |
|---|---|
| ***B66C 23/52*** | (2006.01) |
| ***B66C 1/36*** | (2006.01) |
| *E02B 17/00* | (2006.01) |

(56) References Cited

U.S. PATENT DOCUMENTS 3,843,184 A * 10/1974 Horton, III ..... 294/66.2
3,853,082 A * 12/1974 Rosenberg et al. ..... 114/51
4,518,186 A 5/1985 Hoernberg
4,573,725 A * 3/1986 Griffiths ..... 294/82.28
4,618,179 A * 10/1986 Mampaeij ..... 294/82.31
5,522,631 A * 6/1996 Halonen ..... 294/66.1
6,036,248 A * 3/2000 Fanger et al. ..... 294/82.31

OTHER PUBLICATIONS

Written Opinion for PCT patent application No. PCT/EP2012/055341 issued Jun. 5, 2012.

* cited by examiner

METHOD AND SYSTEM FOR COUPLING AN OFFSHORE STRUCTURE TO A HOISTING BLOCK OF A HOISTING INSTALLATION

The present invention is related to a method for coupling an offshore structure, such as a jacket leg of an offshore platform, to a hoisting block of a hoisting installation, preferably a floating hoisting installation.

Offshore platforms are for instance used for drilling an oil or gas well or for producing oil or gas from a drilled oil or gas well. In relatively shallow water it is known to support such offshore platforms on the seabed by means of so called jackets, typically comprising a plurality of jacket legs extending between the seabed and the so-called topside of the offshore platform, and a lattice structure interconnecting said jacket legs.

When such an offshore platform has reached the end of its economical life the topside and the jackets supporting the topside have to be removed.

It is proposed to remove the topside from the jackets and to subsequently lift the jacket from the seabed by means of a floating hoisting installation and place the lifted jacket on the deck of a vessel or on a barge.

For this purpose hoisting blocks of the hoisting installation are to be coupled to the jacket legs of the jacket.

The present invention has for its object to provide a method and system an offshore structure to a hoisting block of a hoisting installation.

The method according to the invention comprises the steps of:

providing a coupling structure comprising the steps of:

providing said hoisting block with a first coupling part; and providing said offshore structure with a second coupling part;

wherein said first coupling part and said second coupling part are connectable to provide a coupling of said offshore structure to said hoisting block for hoisting said offshore structure by means of said hoisting installation;

and connecting said first coupling part to said second coupling part such that said offshore structure is coupled to said hoisting block;

wherein the method further comprises the steps of:

providing a catching structure for catching at least one of said first coupling part and said second coupling part, said catching structure defining a catch area in which said catching structure is operative;

providing a positioning structure for positioning said first coupling part and said second coupling part relative to each other in a connecting position wherein said first coupling part and said second coupling part are connectable;

bringing at least one of the first coupling part and the second coupling part in the catch area;

catching the coupling part brought into the catch area by means of the catching structure; and positioning the caught coupling part by means of the positioning structure in the connection position before connecting said first coupling part to said second coupling part.

By providing both the hoisting block and the offshore structure with connectable coupling parts and providing a catching structure and a positioning structure, a quick and safe positioning of the coupling parts in the connection position thereof, and subsequent connection of the coupling parts is made possible, in particular in view of the complex relative movements between the offshore structure and the hoisting block.

Such complex relative movements are for instance the result of the relatively large number of degrees of freedom of motion of the offshore structure and the hoisting installation relative to each other in case at least one of the offshore structure and the hoisting installation is floating, said degrees of freedom including moving up and down (heaving), moving left and right (swaying), moving forward and backward (surging), tilting forward and backward (pitching), turning left and right (yawing); and tilting side to side (rolling). Additional complexity is added to the relative movements between the hoisting block and the offshore structure as a result of the tendency of the hoisting block to sway like a pendulum in case of a hoisting block that is suspended from cables.

In a preferred embodiment of the method according to the invention the method comprises before the step of positioning the caught coupling part in said connection position, the steps of:

restricting motion of the caught coupling part relative to the other coupling part in a number of directions by means of said catching structure while allowing at least one direction of motion, and defining by means of said positioning structure a path along which the caught coupling part is guided when said caught coupling part moves in said at least one allowed direction of motion, such that when said caught coupling part moves along said path said caught coupling part is positioned in said connection position.

Because of the set path along which the caught coupling part moves, this development allows for particularly good control of the positioning of the caught coupling part in the connection position.

In an advantageous embodiment of the method according to the invention the first coupling part is brought into the catch area, is caught, and is positioned in the connection position. Since the hoisting block is suspended from the hoisting cables of the hoisting installation it is movable relative to the offshore structure to be coupled thereto. By bringing the first coupling part into the catch area, catching the first coupling part, and positioning the first coupling part into the connection position, it is possible to make use of this intrinsic moveability of the hoisting block and avoid the provision of a construction for making the second coupling part moveable relative to the offshore structure.

In an advantageous embodiment thereof the first coupling part to be caught is brought in a catching position within the catch area, wherein the catching of the first coupling part to be caught comprises the steps of:

moving an engagement member of the catching structure to engage the first coupling part while in the catch position. This step makes it possible to make less use of the gravitational force acting on the hoisting block to catch the first coupling part. Due to the relatively large weight of a hoisting block suitable for hoisting an offshore structure such as a jacket of an offshore platform, the gravitational force acting on the hoisting block are relatively large and relatively hard to control. Moving an engagement member of the catching structure to engage the first coupling part while in the catch position, thus has the advantage of increased control over the catching of the first coupling part.

In a further advantageous embodiment of the method according to the invention wherein the first coupling part is brought into the catch area, is caught, and is positioned in the connection position, the first coupling part to be caught is brought in a catch position within the catch area, and is caught while in said catch position, wherein the positioning of the caught first coupling part comprises the steps of:

engaging the caught first coupling part by means of an engagement member of the positioning structure; and moving the caught first coupling part from the catch position towards the connection position by moving the engagement member. Moving the caught first coupling part from the catching position towards the connection position by moving the engagement member makes it possible to use the gravitational force acting on the hoisting block to keep the first coupling part and the engagement member of the positioning structure engaged. Furthermore, moving the caught first coupling part from the catch position towards the connection position by moving the engagement member makes it possible to decrease the use of the gravitational force acting on the hoisting block to move the first coupling part towards the coupling position. Due to the relatively large weight of a hoisting block suitable for hoisting an offshore structure such as a jacket of an offshore platform, the gravitational force acting on the hoisting block are relatively large and relatively hard to control. Moving the caught first coupling part from the catch position towards the connection position by moving the engagement member thus has the advantage of increased control over the positioning of the first coupling part.

In a further advantageous embodiment of the method according to the invention with the first coupling part brought in the catch position the coupling part is engaged by the engagement member of the catching structure and by the engagement member of the positioning structure on the side of the first coupling part facing the second coupling part, and the engagement member of the catching structure and the engagement member of the positioning structure are moved while positioning the first coupling part to a position on the side of the second coupling part facing away from the catch position. With this embodiment it is possible to attach the first coupling part to the hoisting block by means of a wave-compensation structure which allows for movement of the hoisting block relative to the first coupling part, and to allow the hoisting block to move relative to the first coupling part after connecting the first coupling part to the second coupling part on the side of the second coupling part facing the catch position.

The method according to the invention is in particular advantageous in case at least one of said offshore structure and said hoisting installation is floating, as the method makes it possible to have increased control over the coupling of the hoisting block of a hoisting installation to an offshore structure despite the complex movements between the hoisting installation and the offshore structure in case at least one is floating.

The present invention is further related to a system for coupling an offshore structure, such as a jacket leg of an offshore platform, to a hoisting block suspended from hoisting cables of a hoisting installation, comprising:

a coupling structure comprising a first coupling part which is attachable to said hoisting block; and a second coupling part which is attachable to said offshore structure;

wherein said first coupling part and said second coupling part are connectable to provide a coupling of said offshore structure to said hoisting block for hoisting said jacket leg by means of said hoisting installation;

a catching structure for catching at least one of said first coupling part and said second coupling part, said catching structure defining a catch area in which said catching structure is operative; and a positioning structure for positioning said first coupling part and said second coupling part relative to each other in a connecting position wherein said first coupling part and said second coupling part are connectable.

With this system according to the invention it is possible to perform the method of the invention as described herein above. As described with respect to the method according to the invention this system allows for a quick and safe coupling of a hoisting block to an offshore structure.

In a preferred embodiment of the system according to the invention:

the catching structure is arranged to restrict motion of the caught coupling part relative to the other coupling part in a number of directions while allowing at least one direction of motion; and the positioning structure is arranged to define a path along which the caught coupling part is guided when said caught coupling part moves in said at least one allowed direction of motion, such that when said caught coupling part moves along said path said caught coupling part is positioned in said connection position.

Because of the defined path along which the caught coupling part is guided, this development allows for particularly good control of the positioning of the caught coupling part in the connection position.

In an advantageous embodiment of the system according to the invention the catching structure and the positioning structure are integrated in a catching and positioning structure comprising:

a hook member having a hook at a first end thereof and being rotatable attached with a second end thereof to one of the first coupling part and the second coupling part about a first axis of rotation; and a hook engagement member attached to the other one of the first coupling part and the second coupling part, with which the hook of the hook member is engageable such that the hook member is rotatable about a second axis of rotation defined by said hook engagement member and thus the coupling part to which the hook member is attached is rotatable about said second axis of rotation following a circular path line;

wherein when said coupling part follows said circular path line it is positioned in the connection position. This embodiment provides an integration of the coupling structure and the positioning structure, resulting in a relatively simple and robust structure for both catching a coupling part to be caught and positioning of the caught coupling part relative to the other coupling part.

In an advantageous embodiment thereof:

the first coupling part comprises a first connection hole having a first connection axis; and the second coupling part comprises a second connection hole having a second connection axis;

wherein in the connection position of the first coupling part and the second coupling part the first connection axis coincides with the second connection axis such that a connection pin can be brought in the first hole and the second hole in order to connect the first coupling part and the second coupling part;

wherein the first axis of rotation coincides with the connection axis of the coupling part the hook member is attached to;

the first axis of rotation, the second axis of rotation, and the connection axis of the coupling part the hook engagement member is attached to, are parallel relative to one another; and when the hook of the hook member is engaged with the hook engagement member, the circular path line followed by said connection axis of the coupling part the hook member is attached to, crosses the connection axis of the coupling part the hook engagement member is attached to. This embodiment makes a relatively simple and robust connection of the coupling parts possible once they are both in the connection position.

In an advantageous embodiment thereof the system comprises a connection pin moveable attached to one of said first coupling part and said second coupling part, such that with the first coupling part and the second coupling part in the connection position the connection pin is movable in the first connection hole and the second connection hole. This embodiment provides a quick connection of the coupling parts once they are both in the connection position. In a preferred embodiment thereof the connection pin is moveable by means of an actuator. This allows for a remote initiation of the connection of the coupling parts once they are both in the connection position.

In a further advantageous embodiment of the system according to the invention comprising a hook member and a hook engaging member, the hook engaging member is rotatable attached to said other one of the first coupling part and the second coupling part about a third axis of rotation, such that said second axis of rotation defined by said hook engagement member is rotatable about said third axis of rotation following a circular path line comprising at least a position of said second axis of rotation, wherein when the hook of the hook member is rotatable engaged with the hook engagement member about said second axis of rotation, the coupling part to which the hook member is attached is positioned in the connection position when rotated about said second axis of rotation. This embodiment allows for increasing the catch area of the catching structure, for first bringing the first coupling part into a catching position within the catch area and subsequently moving the hook engaging member of the catching structure to engage the first coupling part while in the catching position, and for moving the caught first coupling part from the catching position.

In a further advantageous embodiment of the system according to the invention having a hook member and a hook engaging member at least one of the hook member and the hook engaging member is rotatable about the first axis of rotation and the third axis of rotation respectively by means of an actuator. This embodiment allows for actuation of the rotation of at least one of the hook member and the hook engaging member.

In a further advantageous embodiment of the system according to the invention having a hook member and a hook engaging member the system further comprises positioning means for releasable maintaining the hook member in a catch position. This embodiment allows for the hook member to be positioned in a position in which the hook member is most likely to be engaged by the hook engaging member when catching the first coupling part, and to be released of that position after being engaged by the hook engaging member to be able to be positioned in a position for positioning the first coupling part in the connection position. In a preferred embodiment thereof the positioning means comprise:

an additional hook member having a hook at a first end thereof and being rotatable attached with a second end thereof to the hook member about a fourth axis of rotation, and an additional hook engaging member attached to the coupling part to which the hook member is attached, with which additional hook engaging member the hook of the additional hook member is engageable to releasable maintain the hook member in said catching position. This embodiment is simple and robust, and allows for releasing the hook member without the use of a separate actuator.

In a further advantageous embodiment of the system according to the invention having a hook member and a hook engaging member the catching structure further comprises a funnel structure connected to one of the hook member and the hook engaging member for engaging the other one of the hook member and the hook engaging member and guiding said other one of the hook member and the hook engaging member guiding the hook member towards said one of the hook member and the hook engaging member. The funnel structure allows for aligning the hook member and the hook engaging member in the direction of the second axis of rotation defined by the hook engaging member.

In a further advantageous system according to the invention the first coupling part is attached to the hoisting block by means of a wave-compensation member which is with one end thereof rotatable attached to the hoisting block and with the another end thereof attached to the first coupling part. This embodiment allows for compensation of movement of the hoisting block relative to the offshore structure after connecting the first coupling part and the second coupling part, and before the lifting operation, for instance as a result of motion of the vessel supporting the hoisting installation initiated by waves. Preferably the wave-compensation member allows for heave motion of the hoisting block relative to the offshore structure.

In a further advantageous embodiment of the system according to the invention at least one of the first coupling part and the second coupling part comprises a support for supporting the other one of the first coupling part and the second coupling part in the connection position wherein the first coupling part and the second coupling part are connectable. This support allows for defining of the connection position. In a preferred embodiment thereof the support is saddle shaped. This makes it possible to guide the coupling part to be positioned towards the connection position once that coupling part has nearly reached the connection position.

Though the system according to the invention as described herein above is especially suitable for coupling a jacket leg of an offshore platform to a hoisting block suspended from hoisting cables of a hoisting installation, it would also be suitable for coupling other onshore or offshore constructions than a jacket leg to a hoisting block suspended from hoisting cables of a hoisting installation.

The present invention is further related to a hoisting block provided with a first coupling part of a system according to the invention as described herein above.

The present invention is further related to an offshore structure, preferably a jacket comprising a jacket leg, provided with a second coupling part of a system according to the invention as described herein above.

The present invention is further related to a method for coupling a jacket of an offshore platform comprising a number of jacket legs to hoisting blocks suspended from hoisting cables of a hoisting installation, wherein each jacket leg is coupled to a hoisting block according to the method for coupling a jacket leg of an offshore platform to a hoisting block suspended from hoisting cables of a hoisting installation according to the invention as described herein above.

The present invention is further elucidated in the following description with reference to the accompanying schematic figures.

Figure 1:
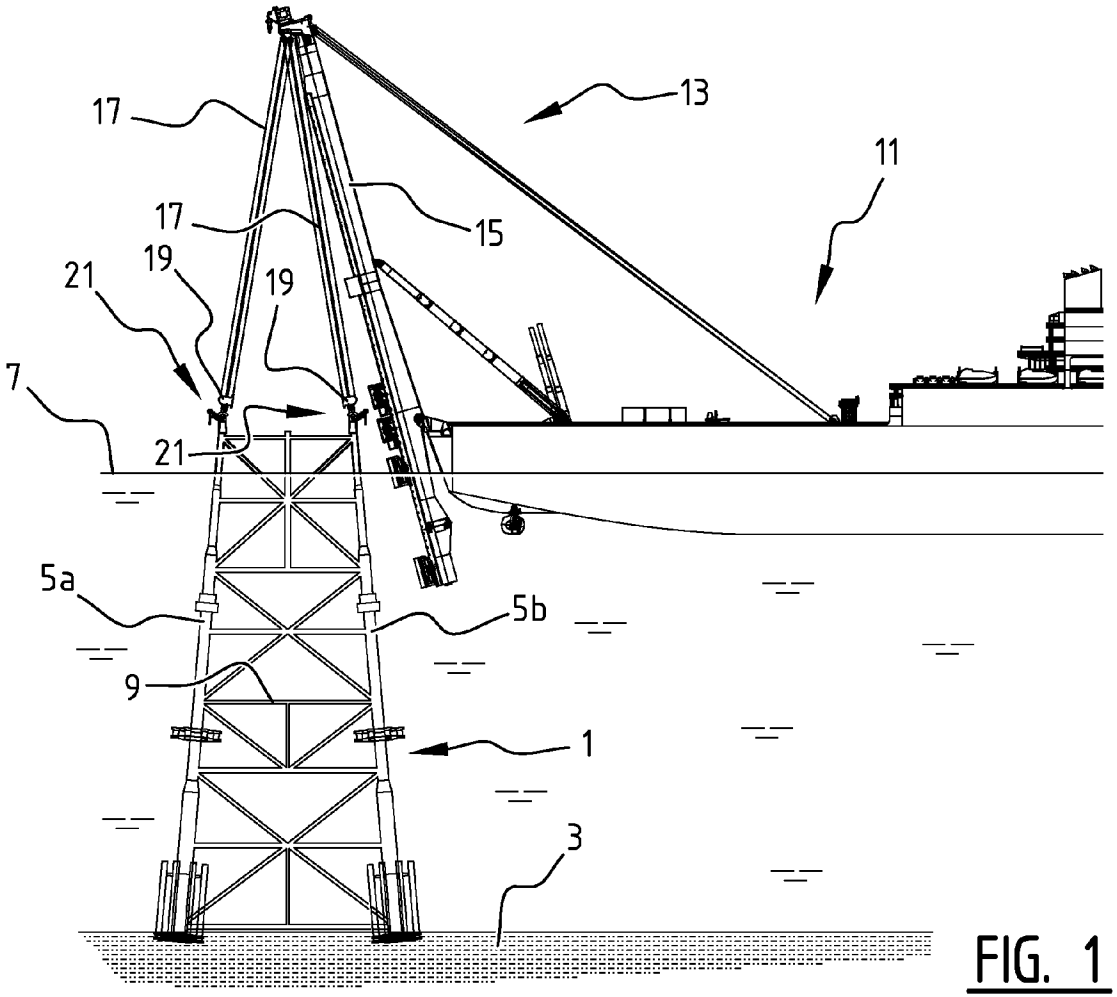
FIG. 1 shows a side view of a jacket and a vessel supporting a hoisting installation wherein the jacket legs are coupled to hoisting blocks of the hoisting installation by means of a system according to the invention.

FIG. 1 shows an offshore structure in the form of a jacket 1 of an offshore platform. The jacket 1 is supported on the seabed 3 and comprises a plurality of jacket legs 5 extending from the seabed 3 towards the sea surface 7. The jacket legs 5*a*, 5*b* are interconnected by a lattice structure 9. At the sea surface 7 a vessel 11 supporting a hoisting installation 13 is shown. The hoisting installation 13 is shown with a hoisting boom 15 from which hoisting cables 17 extend towards the jacket legs 5*a*, 5*b*. Each jacket leg 5*a*, 5*b* is coupled to a hoisting block 19 suspended from the hoisting cables 17 by means of a coupling system 21. Alternatively the hoisting block 19 may be suspended from chains or other means for coupling the hoisting block to and moving the hoisting block relative to the hoisting installation for hoisting.

Figure 2:
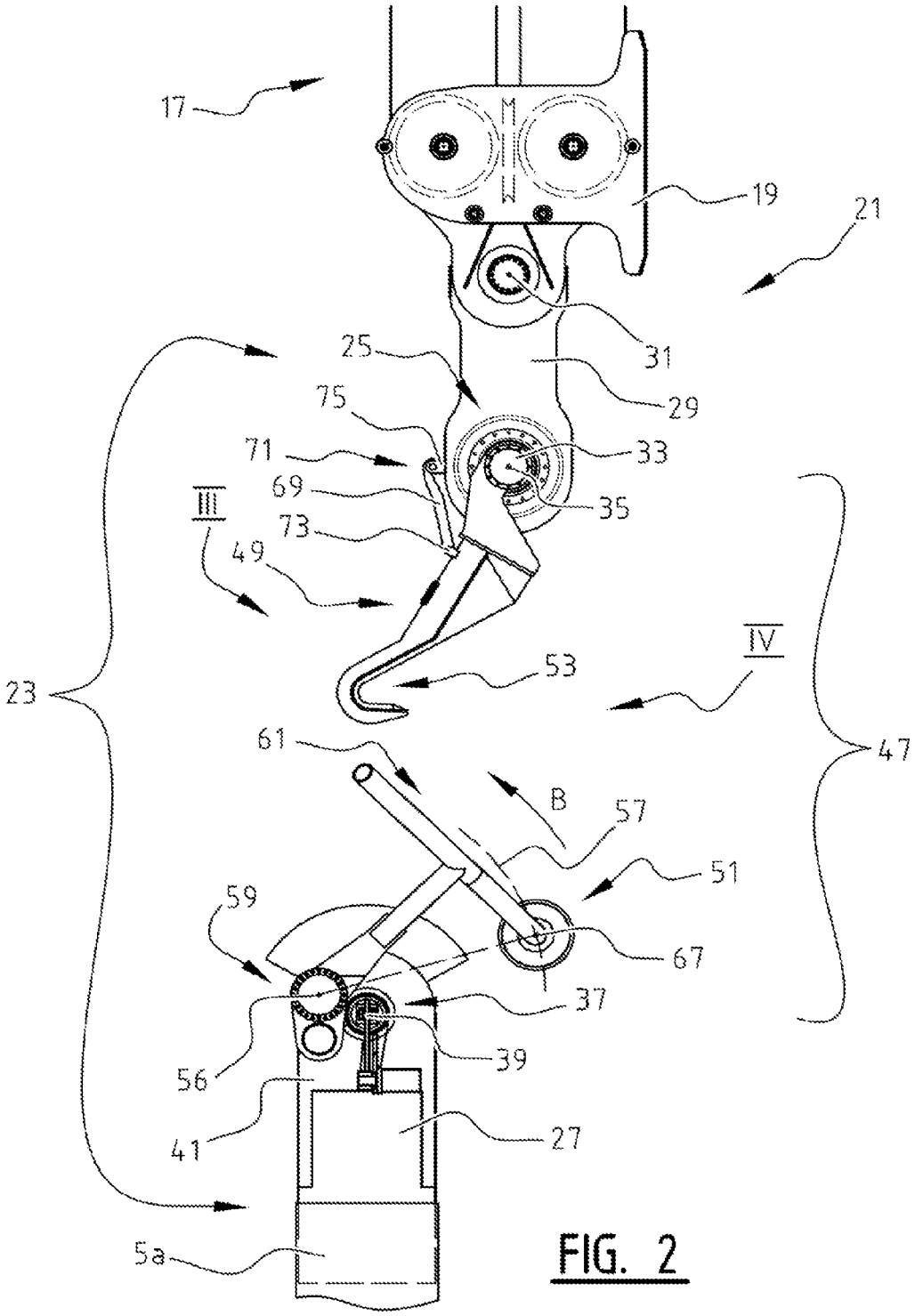
FIG. 2 shows a side view of an embodiment of the system according to the invention.
Figure 3:
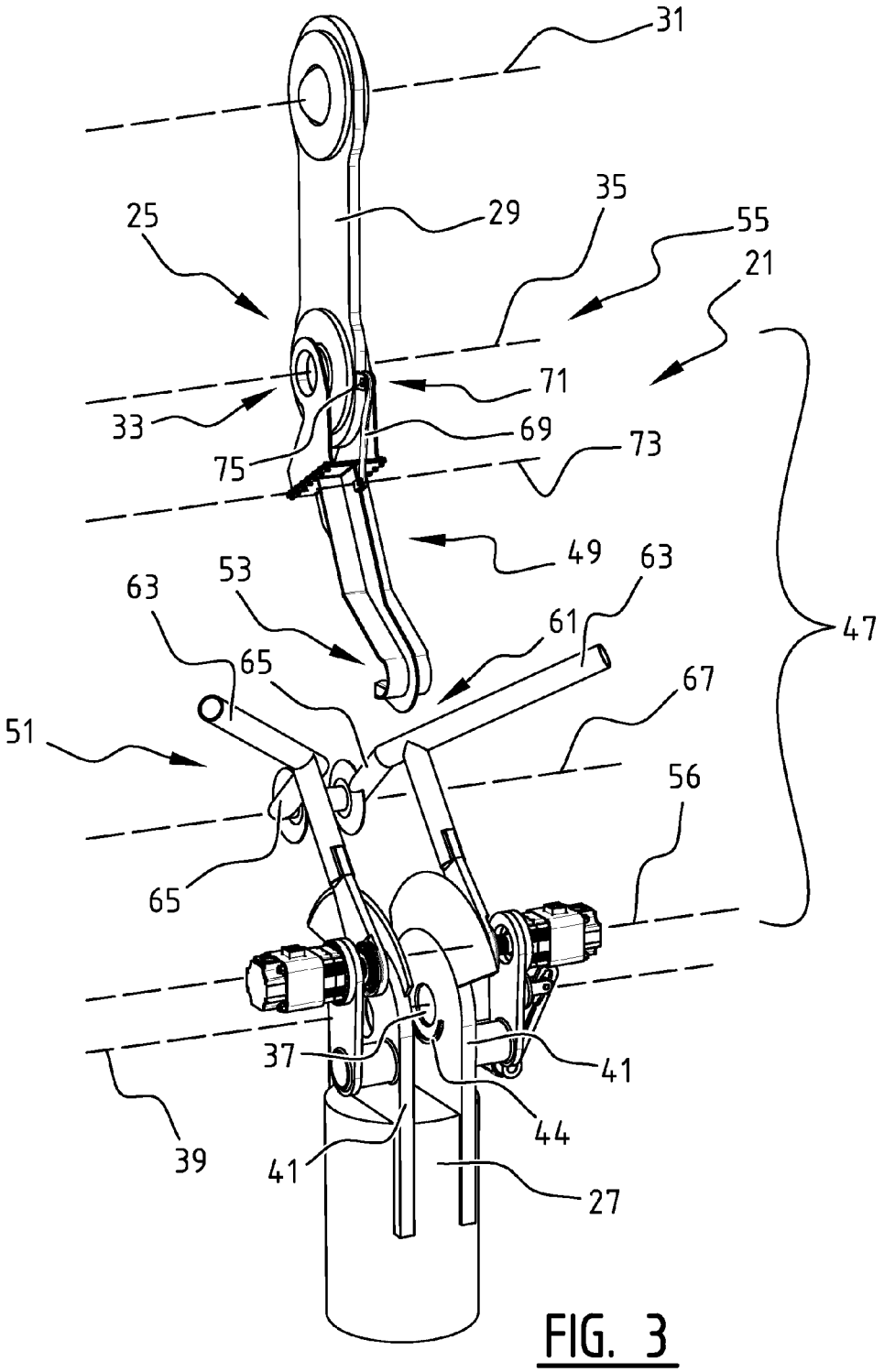
FIGS. 3 and 4 show a perspective view of the embodiment of the system of FIG. 2.
Figure 4:
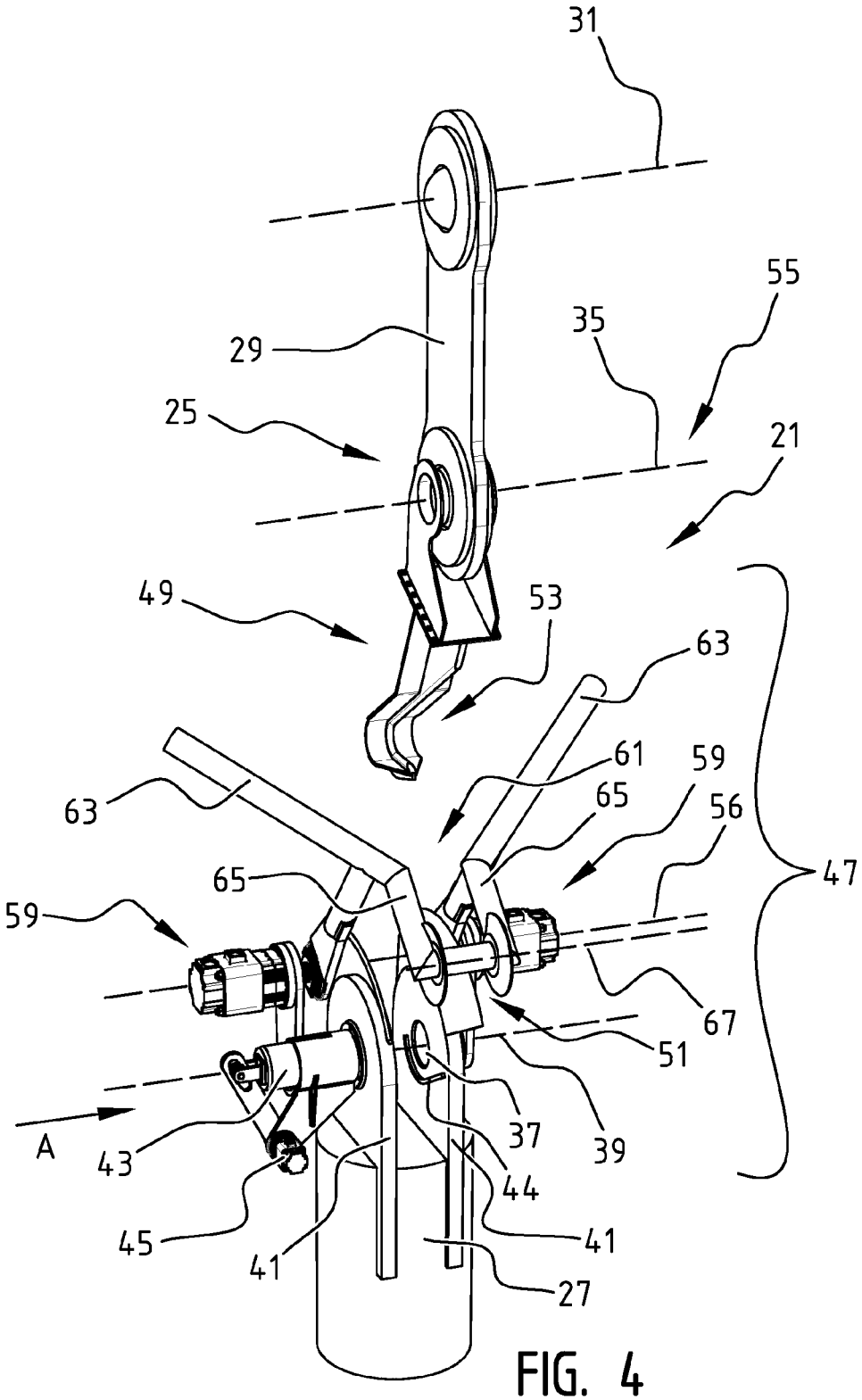

FIG. 2 shows the coupling system 21 before the hoisting block 19 suspended from the hoisting cables 17 is coupled to the jacket leg 5*a*. FIGS. 3 and 4 show the coupling system 21 of FIG. 2 without the jacket leg 5*a* and the hoisting block 19. In the following the coupling system 21 is described with reference to FIGS. 2 to 4.

The coupling system 21 is shown with a coupling structure 23 formed by a first coupling part 25 and a second coupling part 27. The first coupling part 25 is attached to the hoisting block 19 (only shown in FIG. 2) by means of a wave-compensation member 29 which is rotatable attached to the hoisting block about an axis of rotation 31. The first coupling part 25 has a first connection hole 33 having a first connection axis 35. The second coupling part 27 has a second connection hole 37 having a second connection axis 39. The first coupling part 25 and the second coupling part 27 are connectable by positioning the first coupling part 25 into a connection position between the flanges 41 of the second coupling part 27 and on the saddle shaped supports 44 on each flange 41, such that the first connection axis 35 of the first connection hole 33 and the second connection axis 39 of the second connection hole 37 provided in the flanges 41 coincide. The connection between the first coupling part 25 and the second coupling part is subsequently effectuated by moving the connection pin 43 by means of the actuator 45, which is powered by a power supply (not shown), in the direction of arrow A, such that the connection pin 43 is brought into the first- and second connection holes 33, 37.

For catching and positioning the first coupling part 25 into the connection position, the coupling system 21 has an integrated catching- and positioning structure 47 comprising a hook member 49 and a hook engaging member 51. The hook member 49 has a hook 53 at a first end thereof and is rotatable attached with a second end thereof to the first coupling part 25 about a first axis of rotation 55 which coincides with the first connection axis 35. The hook engaging member 51 is rotatable attached to the second coupling part 27 about a third axis of rotation 56 following a circular path line 57. The rotation of the hook engaging member 51 is actuated by actuators 59 which are powered by a power supply (not shown).

The integrated catching- and positioning structure 47 further comprises a funnel structure 61 connected to the hook engaging member 51 and having a number of engaging elements 63, 65 for engaging the hook member 49 and guiding the hook member 49 towards the hook engaging member 51. The engagement members 63, 65 are arranged to align the hook member 49 and the hook engaging member 51 in the direction of an axis of rotation 67 defined by the hook engaging member 51 about which axis of rotation 67 the hook member 49 is rotatable when the hook 53 of the hook member 49 is in engagement with the hook engaging member 51 as will be further elucidated in the description of FIGS. 5 to 12.

In the situation as shown in FIGS. 2 to 4 the hook member 49 is releasable held in a catch position by means of positioning means formed by an additional hook member 69 having a hook 71 at a first end thereof and being rotatable attached with a second end thereof to the hook member 49 about a fourth axis of rotation 73, and an additional hook engagement member 75 attached to the first coupling part 25 with which the hook 71 of the additional hook member 69 is engaged.

In the embodiment of the coupling system as shown in FIGS. 2 to 4 all axis referred to 31, 35, 39, 55, 56, 67, and 73 are oriented parallel relative to each other.

Figure 5:
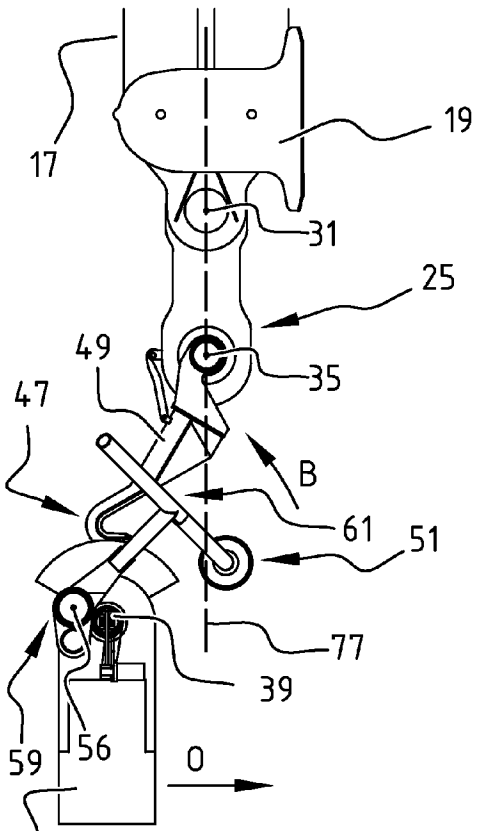

In the situation as shown in FIG. 2, the coupling system 21 is ready to be used. The first coupling part 25 is in FIG. 2 positioned such that it is outside the catch area of the integrated catching- and positioning structure 47, i.e. the hook 53 of the hook member 49 is positioned such that when the hook engaging member 51 is rotated about the third axis of rotation 56 in the direction of arrow B, the hook engaging member is not brought in engagement with the hook 53 of the hook member 49. By lowering the hoisting block 19 the first coupling member 25 is brought into the catch area of the integrated catching- and positioning structure 47, as shown in FIG. 5. In this catch position of the first coupling part 25 the hook 53 of the hook member 49 is positioned such that when the hook engaging member 51 is rotated about the third axis of rotation 56 in the direction of arrow B, the hook engaging member 51 is brought in engagement with the hook 53 of the hook member 49 as will be described with reference to FIGS. 6 to 9. Furthermore, as shown in FIG. 5 the hoisting block 19 is in the catch position freely suspended from the hoisting cables 17 such that a vertical line 77 crossing the first connection axis 35 is positioned such that the vertical line 77 is offset from the second connection axis 39 in the direction indicated with the arrow O opposite to the direction in which the first connection axis 35 is to be brought to coincide with the second connection axis 39.

Figure 6:
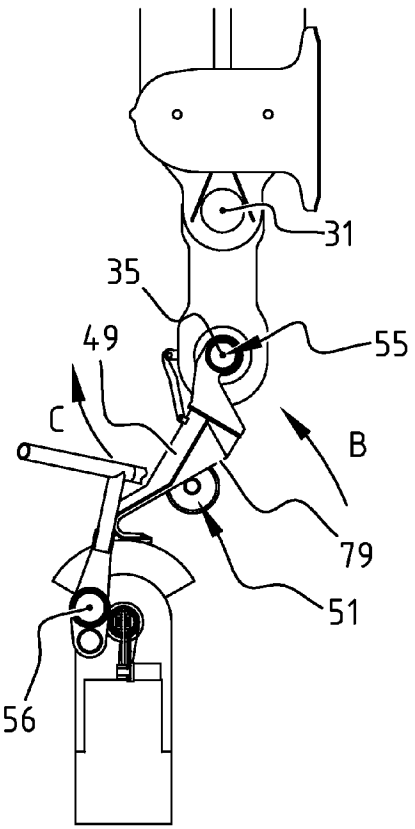

By powering the actuators 59 the hook engaging member 51 and the funnel structure 61 is rotated in the direction of arrow B, such that the hook engaging member 51 engages a guiding edge 79 of the hook member 49 as shown in FIG. 6. Before the hook engaging member 51 engages the guiding edge 79 of the hook member 49 the hook member 49 is engaged by the funnel structure 61 and guided towards the hook engagement member 51 in case the hook engagement member 51 and the hook member 49 were not aligned in the direction perpendicular to the plane of the drawing, i.e. perpendicular to the third axis of rotation 56.

Figure 7:
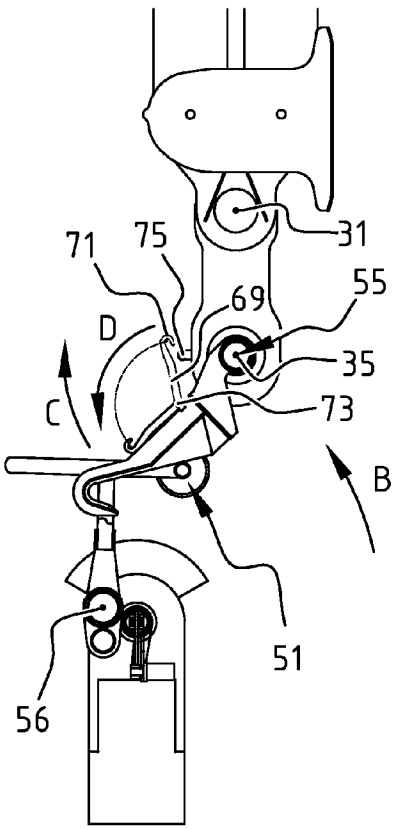
FIGS. 5 to 13 show in side view the embodiment of the system according to the invention of FIG. 2 in subsequent steps of the method according to the invention.

When the hook engagement member 51 is further rotated about the third axis of rotation 56 in the direction of arrow B the hook member 49 is pushed upwards and is rotated about the first axis of rotation 35 in the direction of arrow C such that as shown in FIG. 7 the hook 71 of the additional hook member 69 is disengaged from the additional hook engaging member 75 and rotates about the fourth axis of rotation 73 in the direction of arrow D.

Figure 8:
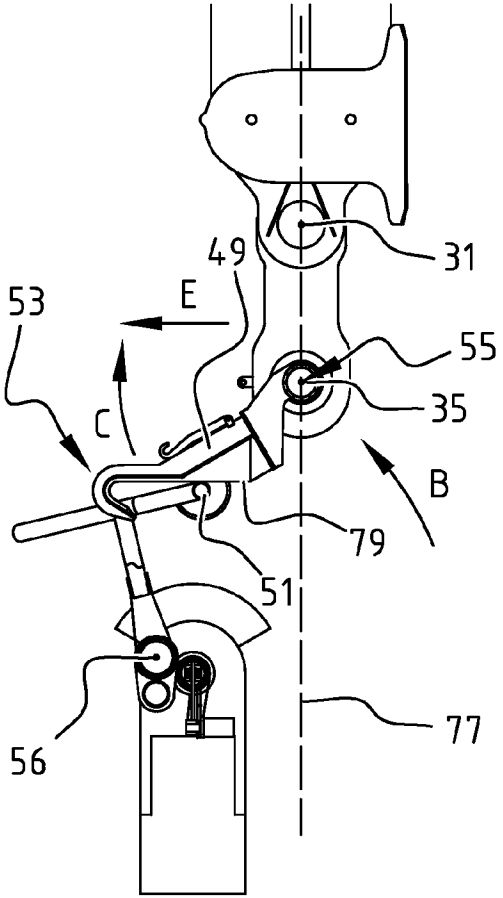

When the hook engagement member 51 is still further rotated about the third axis of rotation 56 in the direction of arrow B the hook engagement member 51 is moved along the guide edge 79 of the hook member 49 in the direction of arrow E towards the hook 53 of the hook member 49 as shown in FIG. 8, wherein the hook member 49 is further rotated about the first axis of rotation 55 in the direction of arrow C, until the hook engagement member 51 is in engagement with the hook 53 of the hook member 49.

Figure 9:
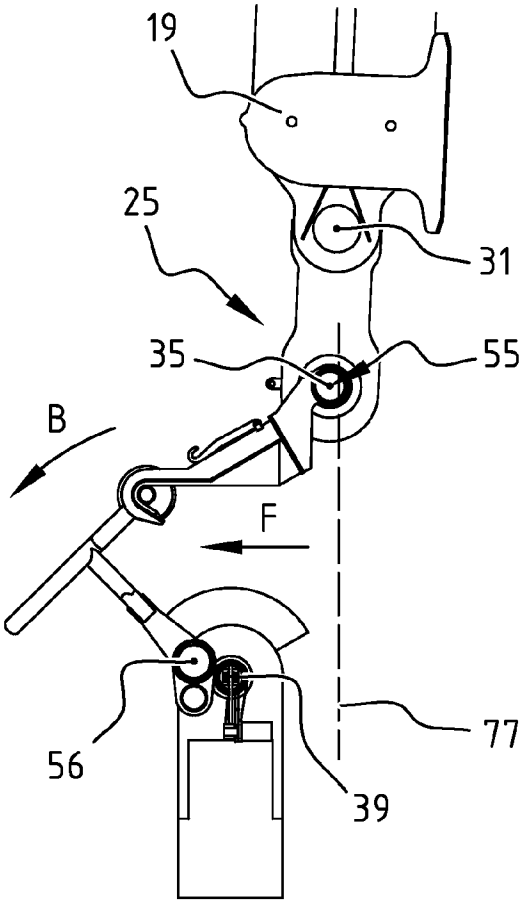

When after the engagement of the hook engagement member 51 and the hook 53 of the hook member 49, the hook engagement member 51 is further rotated about the third axis of rotation 56 in the direction of arrow B the first coupling part 25 and the hoisting block 19 are pulled away from the catching position in which the vertical line 77 crossed the first connection axis 35 in the direction of the second connection axis, i.e. in the direction of arrow F, as shown in FIG. 9.

Figure 10:
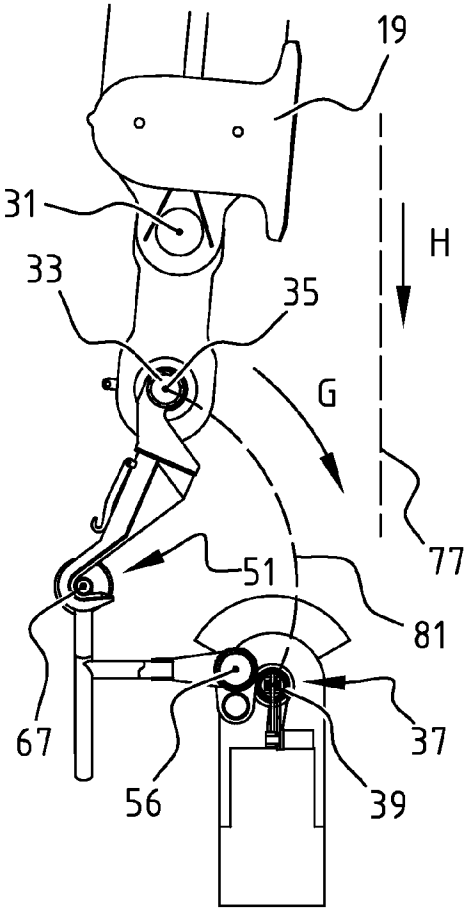

In FIG. 10 is shown that the hook engagement member 51 is further rotated about the third axis of rotation 56 in the direction of arrow B into a position wherein when the hook member 49 is rotated about the second axis of rotation 67 defined by the hook engagement member 51 in the direction of arrow G the first connection axis 35 of the first connection hole 33 follows a circular path line 81 which crosses the second connection axis 39 of the second connection hole 37. By means of the integrated catching- and positioning structure 47 comprising a hook member 49 and a hook engaging member 51 the motion of the caught first coupling part 25 relative to the second coupling part 27 in a number of directions is restricted, in particular all motions are restricted except for motions in the plane of the drawing.

Figure 12:
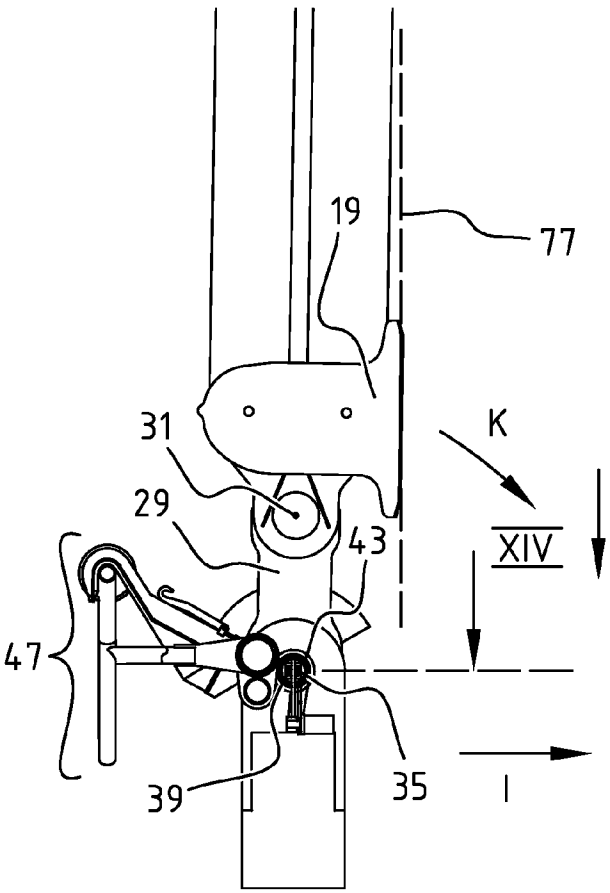
Figure 11:
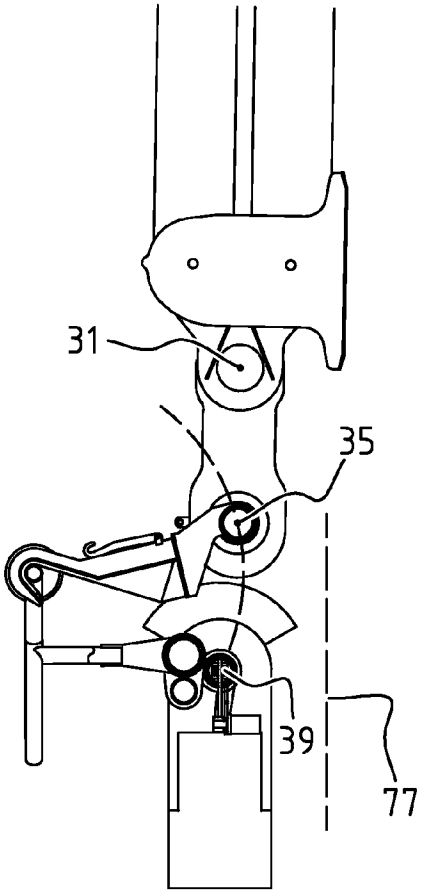

When subsequently the hoisting block 19 is lowered in the direction of arrow H the first connection axis 35 follows the path line 81 as shown in FIG. 11, wherein since the first coupling part 25 and the hoisting block 19 were earlier pulled away from the catching position, the gravitational force acting on the hoisting block 19 and the first coupling structure 25 pulls the first coupling part 25 and the hoisting block 19 towards the catch position, such that the hook 53 of the hook member 49 is pulled against the hook engagement member 51 and remains engaged. When lowering the hoisting block 19 still further the first connection part 25 is positioned in the connection position as shown in FIG. 12 wherein the first connection axis 35 and the second connection axis 39 coincide and the connection pin 43 can be moved in the first connection hole 33 and second connection holes 37 such that the first coupling part 25 is connected to the second coupling part 27 and the hoisting block 19 and the jacket leg 5 are coupled.

To be able to compensate for heave motion of the hoisting block 19 relative to the jacket leg 5 during the connection of the first coupling part 25 and the second coupling part 27 by means of the connecting pin 43, the first hoisting block 19 is lowered a little in the direction of arrow J such that as a result of the gravitational force acting on the hoisting block 19, the hoisting block 19 is pulled in the direction of arrow I and the wave-compensation member 29 is rotated about the connection axis 35 and 39 in the direction of arrow K. This rotation of the wave-compensation member 29 is possible without the connection pin 43 connecting the coupling parts 25, 27, because flanges of the hook member 49, by means of which the hook member 49 is rotatable attached to the first coupling part 25, rest on the saddle shaped supports 44 on each flange 41 of the second coupling part 27 such that the first coupling part 25 is rotatable connected to the second coupling part 27 via hook member 49. The wave-compensation member 29 can thus be brought into the orientation shown in FIG. 13, wherein the hoisting block 19 can move in the direction of heave motion, i.e. in the direction of the arrows L, while the first coupling part 25 remains in the coupling position thereof. As a result the connection pin 43 can be moved in the first connection hole 33 and second connection holes 37 such that the first coupling part 25 is connected to the second coupling part 27 without the influence of movement of the hoisting block 19 relative to the jacket leg 5 in the direction of heave motion as a result of waves acting on the floating hoisting installation.

After coupling the hoisting block 19 to the jacket leg 5*a* a second hoisting block can be coupled to the jacket leg 5*b* which is located in the direction of arrow I. The first hoisting block 19 can due to the wave-compensation member 29 move relative to the connected first and second coupling parts 25, 27. Since the components of the integrated catching- and positioning structure 47 are now located on the side of the second coupling part 27 facing away from the catch position represented in FIG. 12 by the vertical line 77 the rotation of the wave-compensation member 29 in the direction of arrows M is not hindered.

Thus hoisting block 19 is coupled to the jacket leg 5*a* via the first coupling part 25, the second coupling part 27, and wave-compensation member 29. Although the wave-compensation member 29 is preferred, the first coupling part 25 can be coupled directly to the hoisting block 19 in case wave-compensation is not necessary.

Figure 13:
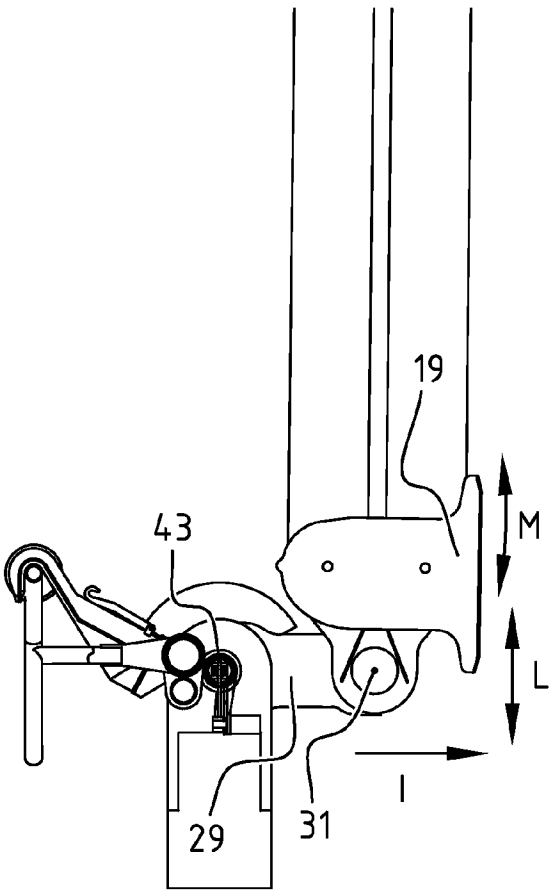

By starting from the situation as shown in FIG. 12 or 13 and performing the described steps in the opposite sequence, the hoisting block and the jacket leg can be uncoupled.

Figure 14:
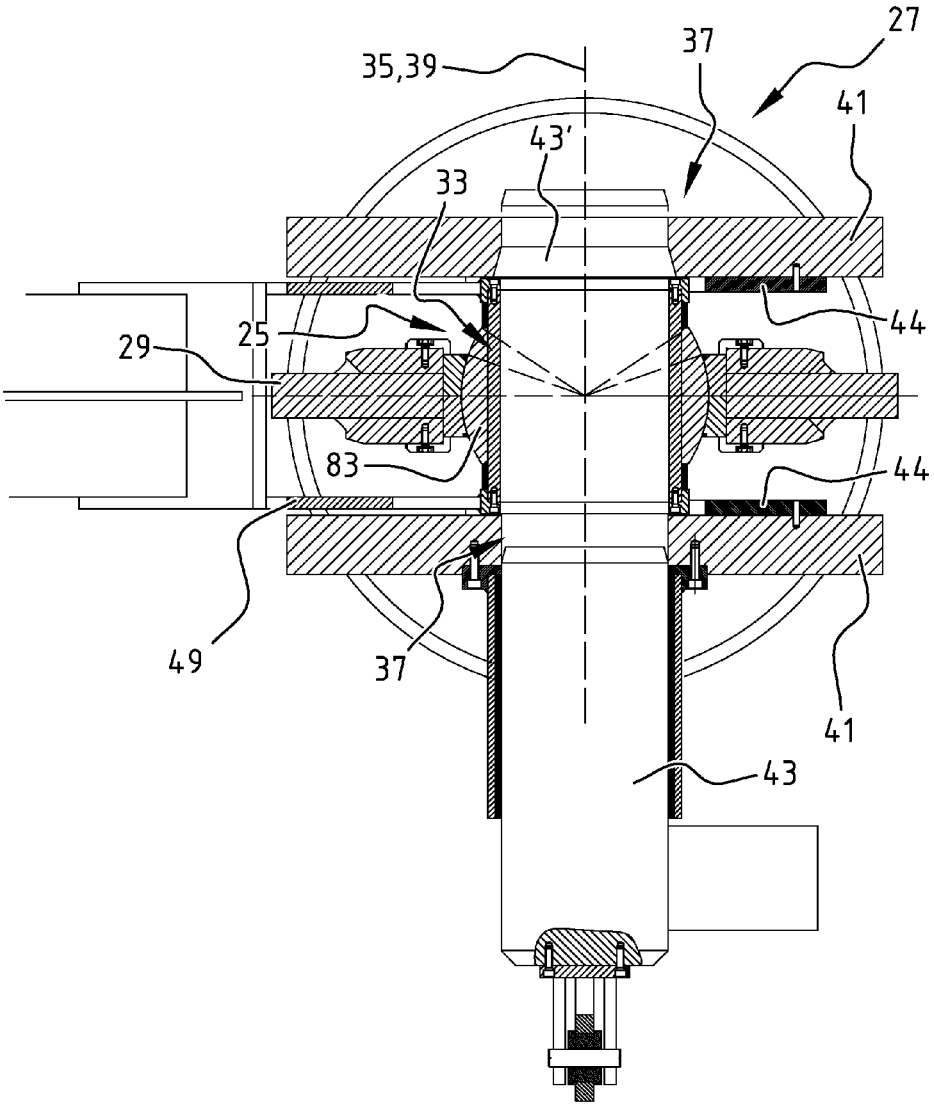
FIG. 14 shows a detail view in cross section of second coupling part of the embodiment of the system according to the invention in the situation shown in FIG. 12.

In FIG. 14 a cross section through the flanges 41 of the second coupling part 27, the first connection part 25, the wave-compensation member 29 and the hook member 49 is shown at the first connection hole 33 and second connection holes 37, while the first connection axis 35 and the second connection axis 39 coincide. Shown in FIG. 14 is the connection pin 43 in a position wherein the connection pin is not brought into the first connection hole 33 and second connection holes 37, and the connection pin 43' in a position wherein the connection pin is brought into the first connection hole 33 and second connection holes 37. As shown in FIG. 14 the first coupling part 25 comprises a ball bearing 83.

In the embodiment of the system according to the invention as shown in FIGS. 2 to 14 the components of the system that are to be actuated by means of an actuator are moveable attached to the second coupling part which is attached to the jacket leg. This makes it possible to avoid having to provide a power supply for powering the actuators via the hoisting block, the hoisting cables and the hoisting boom. It would though be possible to provide parts of the system that are to be actuated on the first coupling part. For instance the rotatable hook engaging member could be provided on the first coupling part and the hook member could be provided on the second coupling part. Also the hook member could be rotatable attached to the first coupling part or the second coupling part by means of an actuator. Also the system could have less actuateable components. The hook engagement member could be stationary attached to one of the first coupling part and second coupling part, for instance in the position as shown in FIGS. 11 and 12. When also the connection pin would not be moveable by means of the actuator, this would result in a passive, i.e. not actuated, system wherein with respect to the embodiment shown in FIGS. 2 to 14 the hoisting block is to be moved relative to the second coupling part to bring the hook of the hook member in engagement with the hook engagement member.

In the embodiment of the system according to the invention as shown in FIGS. 2 to 14 the catching structure and the position structure are integrated in a catching- and positioning structure. The hook engaging member 51 functions as both the engagement member of the catching structure and the engagement member of the positioning structure, and engages the first coupling part via the hook member 49. The funnel structure 61 provides addition engaging members in support of the hook engaging member 51 in its function as engagement member of the catching structure.

It is also possible to have a separate catching structure and positioning structure. Also the separate catching structure and positioning structure or the integrated in a catching- and positioning structure could not be attached to first coupling part and second coupling part, for instance a structure attached to the jacket or to the vessel supporting the hoisting installation.

The description and drawings merely illustrate the principles of the invention. It will thus be appreciated that those skilled in the art will be able to devise various arrangements that, although not explicitly described or shown herein, embody the principles of the invention and are included within its spirit and scope.

Furthermore, all examples recited herein are principally intended expressly to be only for pedagogical purposes to aid the reader in understanding the principles of the invention and the concepts contributed by the inventors to furthering the art, and are to be construed as being without limitation to such specifically recited examples and conditions. Moreover, all statements herein reciting principles, aspects, and embodiments of the invention, as well as specific examples thereof, are intended to encompass equivalents thereof.

The invention claimed is:

1. A method for coupling an offshore structure to a hoisting block of a hoisting installation, comprising:

providing a coupling structure comprising a first coupling part; and a second coupling part;

wherein said first coupling part and said second coupling part are connectable to provide a coupling of said offshore structure to said hoisting block for hoisting said offshore structure by means of said hoisting installation;

connecting said first coupling part to said second coupling part such that said offshore structure is coupled to said hoisting block;

providing a catching structure for catching at least one of said first coupling part and said second coupling part, said catching structure defining a catch area in which said catching structure is operative;

providing a positioning structure for positioning said first coupling part and said second coupling part relative to each other in a connecting position wherein said first coupling part and said second coupling part are connectable;

bringing at least one of the first coupling part and the second coupling part in the catch area;

catching the coupling part brought into the catch area by means of the catching structure; and positioning the caught coupling part by means of the positioning structure in the connection position before connecting said first coupling part to said second coupling part;

wherein the first coupling part is brought into the catch area, is caught, and is positioned in the connection position; and wherein the first coupling part to be caught is brought in a catch position within the catch area, and is caught while in said catch position; and wherein the positioning of the caught first coupling part comprises:

engaging the caught first coupling part by means of an engagement member of the positioning structure; and moving the caught first coupling part from the catch position towards the connection position by moving the engagement member.

2. The method of claim 1, wherein before the step of positioning the caught coupling part in said connection position, the method further comprises:

restricting motion of the caught coupling part relative to the other coupling part in a number of directions by means of said catching structure while allowing at least one direction of motion, and defining by means of said positioning structure a path along which the caught coupling part is guided when said caught coupling part moves in said at least one allowed direction of motion, such that when said caught coupling part moves along said path said caught coupling part is positioned in said connection position.

3. The method of claim 1, wherein the first coupling part to be caught is brought in a catch position within the catch area; and wherein the catching of the first coupling part to be caught comprises moving an engagement member of the catching structure to engage the first coupling part while in the catch position.

4. The method of claim 3, wherein:

with the first coupling part brought in the catching position, the first coupling part is engaged by the engagement member of the catching structure and by the engagement member of the positioning structure on the side of the first coupling part facing the second coupling part; and the engagement member of the catching structure and the engagement member of the positioning structure are moved while positioning the first coupling part to a position on the side of the second coupling part facing away from the catch position.

5. The method of claim 1, wherein at least one of said offshore structure and said hoisting installation is floating.

6. Method for coupling a jacket of an offshore platform comprising a number of jacket legs coupled to hoisting blocks suspended from hoisting cables of a hoisting installation, wherein each jacket leg is coupled to a hoisting block according to the method of claim 1.

7. A system for coupling an offshore structure to a hoisting block of a hoisting installation, comprising:

a coupling structure comprising:

a first coupling part which is attachable to said hoisting block; and a second coupling part which is attachable to said offshore structure, wherein said first coupling part and said second coupling part are connectable to provide a coupling of said offshore structure to said hoisting block for hoisting said offshore structure by means of said hoisting installation;

a catching structure for catching at least one of said first coupling part and said second coupling part, said catching structure defining a catch area in which said catching structure is operative; and a positioning structure for positioning said first coupling part and said second coupling part relative to each other in a connecting position wherein said first coupling part and said second coupling part are connectable;

wherein the catching structure and the positioning structure are integrated in a catching and positioning structure comprising:

a hook member having a hook at a first end thereof and being rotatably attached with a second end thereof to one of the first coupling part and the second coupling part about a first axis of rotation; and a hook engagement member attached to the other one of the first coupling part and the second coupling part, with which the hook of the hook member is engageable such that the hook member is rotatable about a second axis of rotation defined by said hook engagement member and thus the coupling part to which the hook member is attached is rotatable about said second axis of rotation following a circular path line;

wherein when said coupling part follows said circular path line it is positioned in the connection position.

8. The system of claim 7, wherein:

the catching structure is arranged to restrict motion of the caught coupling part relative to the other coupling part in a number of directions while allowing at least one direction of motion; and the positioning structure is arranged to define a path along which the caught coupling part is guided when said caught coupling part moves in said at least one allowed direction of motion, such that when said caught coupling part moves along said path said caught coupling part is positioned in said connection position.

9. The system of claim 7, wherein:

the first coupling part comprises a first connection hole having a first connection axis;

the second coupling part comprises a second connection hole having a second connection axis; wherein in the connection position of the first coupling part and the second coupling part the first connection axis coincides with the second connection axis such that a connection pin can be brought in the first hole and the second hole in order to connect the first coupling part and the second coupling part;

the first axis of rotation coincides with the connection axis of the coupling part the hook member is attached to;

the first axis of rotation, the second axis of rotation, and the connection axis of the coupling part the hook engagement member is attached to, are parallel relative to one another; and when the hook of the hook member is engaged with the hook engagement member, the circular path line followed by said connection axis of the coupling part the hook member is attached to, crosses the connection axis of the coupling part the hook engagement member is attached to.

10. The system of claim 9, further comprising a connection pin movable attached to one of said first coupling part and said second coupling part, such that with the first coupling part and the second coupling part in the connection position the connection pin is moveable in the first connection hole and the second connection hole.

11. The system of claim 7, wherein the hook engagement member is rotatable attached to said other one of the first coupling part and the second coupling part about a third axis of rotation, such that said second axis of rotation defined by said hook engagement member is rotatable about said third axis of rotation following a circular path line comprising at least a position of said second axis of rotation wherein, when the hook of the hook member is rotatable engaged with the hook engagement member about said second axis of rotation, the coupling part to which the hook member is attached is positioned in the connection position when rotated about said second axis of rotation.

12. The system of claim 7, wherein at least one of the hook member and the hook engagement member is rotatable about the first axis of rotation and a third axis of rotation respectively by means of an actuator.

13. The system of claim 7, further comprising positioning means for releasably maintaining the hook member in a catch position, wherein the positioning means comprises:

an additional hook member having a hook at a first end thereof and being rotatably attached with a second end thereof to the hook member about a fourth axis of rotation, and an additional hook engaging member attached to the coupling part to which the hook member is attached, with which additional hook engaging member the hook of the additional hook member is engageable to releasable maintain the hook member in said catching position.

14. The system of claim 7, wherein the catching structure further comprises a funnel structure connected to one of the hook member and the hook engaging member for engaging the other one of the hook member and the hook engaging member and guiding said other one of the hook member and the hook engaging member guiding the hook member towards said one of the hook member and the hook engaging member.

15. The system of claim 7, wherein the first coupling part is attached to the hoisting block by means of a wave-compensation member which is with one end thereof rotatable attached to the hoisting block and with the another end thereof attached to the first coupling part.

16. The system of claim 7, wherein at least one of the first coupling part and the second coupling part comprises a support, for supporting the other one of the first coupling part and the second coupling part in the connection position wherein the first coupling part and the second coupling part are connectable.

17. A hoisting block comprising a first coupling part of a coupling system for coupling an offshore structure to the hoisting block, wherein the first coupling part is coupleable to a second coupling part of a coupling structure of the coupling system which is attachable to said offshore structure, wherein said first coupling part and said second coupling part are connectable to provide a coupling of said offshore structure to said hoisting block for hoisting said offshore structure by means of said hoisting installation; wherein the coupling system further comprises:

a catching structure for catching at least one of said first coupling part and said second coupling part, said catching structure defining a catch area in which said catching structure is operative; and a positioning structure for positioning said first coupling part and said second coupling part relative to each other in a connecting position wherein said first coupling part and said second coupling part are connectable;

wherein the catching structure and the positioning structure are integrated in a catching and positioning structure comprising:

a hook member having a hook at a first end thereof and being rotatably attached with a second end thereof to one of the first coupling part and the second coupling part about a first axis of rotation; and a hook engagement member attached to the other one of the first coupling part and the second coupling part, with which the hook of the hook member is engageable such that the hook member is rotatable about a second axis of rotation defined by said hook engagement member and thus the coupling part to which the hook member is attached is rotatable about said second axis of rotation following a circular path line;

wherein when said coupling part follows said circular path line it is positioned in the connection position.

18. An offshore structure comprising a second coupling part of a coupling system for coupling the offshore structure to a hoisting block, wherein the second coupling part is coupleable to a first coupling part of a coupling structure of the coupling system which is attachable to said hoisting block, wherein said first coupling part and said second coupling part are connectable to provide a coupling of said offshore structure to said hoisting block for hoisting said offshore structure by means of said hoisting installation; wherein the coupling system further comprises:

a catching structure for catching at least one of said first coupling part and said second coupling part, said catching structure defining a catch area in which said catching structure is operative; and a positioning structure for positioning said first coupling part and said second coupling part relative to each other in a connecting position wherein said first coupling part and said second coupling part are connectable;

wherein the catching structure and the positioning structure are integrated in a catching and positioning structure comprising:

a hook member having a hook at a first end thereof and being rotatable attached with a second end thereof to one of the first coupling part and the second coupling part about a first axis of rotation; and a hook engagement member attached to the other one of the first coupling part and the second coupling part, with which the hook of the hook member is engageable such that the hook member is rotatable about a second axis of rotation defined by said hook engagement member and thus the coupling part to which the hook member is attached is rotatable about said second axis of rotation following a circular path line;

wherein when said coupling part follows said circular path line it is positioned in the connection position.

* * * * *

UNITED STATES PATENT AND TRADEMARK OFFICE

CERTIFICATE OF CORRECTION

PATENT NO. : 9,221,654 B2
APPLICATION NO. : 14/007224
DATED : December 29, 2015
INVENTOR(S) : van der Schans et al.

It is certified that error appears in the above-identified patent and that said Letters Patent is hereby corrected as shown below:

In the Claims:

Claim 18, col. 16, line 9, please delete "rotatable" and substitute therefor --rotatably--.

Signed and Sealed this
Twenty-third Day of August, 2016

Michelle K. Lee

Michelle K. Lee
*Director of the United States Patent and Trademark Office*